US005147050A

United States Patent [19]

Cullen

[11] Patent Number: 5,147,050

[45] Date of Patent: Sep. 15, 1992

[54] CUSTOM HANGING RACK WITH INTERCHANGEABLE SUPPORT HOOKS AND METHOD THEREFOR

[75] Inventor: Lawrence E. Cullen, Chicago, Ill.

[73] Assignee: Surface Sciences, Inc., Chicago, Ill.

[21] Appl. No.: 722,133

[22] Filed: Jun. 27, 1991

[51] Int. Cl.[5] ..... A47F 5/00

[52] U.S. Cl. ..... 211/118; 211/117; 211/119; 118/500; 204/297 W

[58] Field of Search ..... 211/113, 119, 117, 118; 204/297 R, 297 W; 118/500

[56] References Cited

U.S. PATENT DOCUMENTS

| | | | |
|---|---|---|---|
| 1,226,856 | 5/1917 | Bradley . | |
| 1,452,321 | 2/1922 | Allen . | |
| 1,533,805 | 4/1925 | Oliver | 204/297 W |
| 2,730,988 | 1/1956 | Starkey | 118/51 |
| 2,858,265 | 10/1958 | Schneider | 211/182 X |
| 2,858,266 | 10/1958 | Schneider | 211/182 X |
| 2,953,512 | 9/1960 | Villette | 204/297 W |
| 3,029,952 | 4/1962 | Bagdon et al. | 211/117 |
| 3,272,733 | 9/1966 | Belke | 204/297 W |
| 3,294,668 | 12/1966 | Belke | 204/297 W |
| 3,376,156 | 4/1968 | Whitaker et al. | 117/93.2 |
| 4,037,727 | 7/1977 | Kunkle | 211/117 |
| 4,097,359 | 6/1978 | Davitz | 204/297 W |
| 4,217,853 | 8/1980 | Davitz | 118/500 |
| 4,243,146 | 1/1981 | Davitz | 211/118 |
| 4,289,090 | 9/1981 | Bagby et al. | 118/630 |
| 4,424,908 | 1/1984 | Davitz | 211/118 |
| 4,450,954 | 5/1984 | O'Connell | 198/793 |
| 4,752,371 | 6/1988 | Kreisel et al. | 204/297 W |
| 4,831,962 | 5/1989 | Gros | 118/423 |

FOREIGN PATENT DOCUMENTS

| | | |
|---|---|---|
| 1079916 | 4/1960 | Fed. Rep. of Germany . |
| 893056 | 4/1962 | United Kingdom . |

*Primary Examiner*—Robert W. Gibson, Jr.
*Attorney, Agent, or Firm*—Fitch, Even, Tabin & Flannery

[57] ABSTRACT

Disclosed is a support rack for transporting workpieces through electrostatic coating operations. The support rack includes hollow, horizontally mounted crossbars having open ends into which support hooks formed of bent rod stock are detachably engaged. The support hooks include a workpiece engaging portion upon which workpieces are supported and a crossbar engaging portion which engages with a crossbar. Each crossbar includes inwardly extending indentations in proximity with the open ends which engage with a complementary bend formed in the crossbar engaging portion of the support hook to secure the support hook within the crossbar.

17 Claims, 2 Drawing Sheets

CUSTOM HANGING RACK WITH INTERCHANGEABLE SUPPORT HOOKS AND METHOD THEREFOR

FIELD OF THE INVENTION

This invention relates to support racks used for supporting workpieces in electrically conductive contact during transport through an electrostatic finishing system, and more particularly, to such support racks having removable, interchangeable support hangers.

BACKGROUND OF THE INVENTION

Workpieces are supported on support racks and carried along by a conveyor through a finishing system which may include the steps of cleaning, rinsing, drying, coating and baking. Usually finishing includes travel through an electrostatic spray booth wherein the workpieces are sprayed and coated with electrically charged particulate. Workers then remove the finished, coated workpieces from the racks and reuse the racks for subsequent operations. Since the racks are constantly recycled through the finishing system, they become encrusted with multiple layers of the coating material after several runs.

It is important in electrostatic coating operations that the support rack be electrically conductive, whereby workpieces can be maintained in a grounded electrical state. The workpieces are electrically connected to ground potential through the conductive support rack so that the electrically charged coating particulate is attracted by an electric field to the workpieces. Good grounding is important in order to provide a uniform particulate distribution over the entire workpiece. Thus, it is desirable to provide a support rack wherein the electrical contact between each workpiece and the main frame of the support rack is maintained as a good, low resistance electrical contact so that the suspended workpieces will remain well grounded.

It is known to provide support racks having support hooks upon which articles are hung. Each painting or coating operation applies a coating layer to the exposed, article-engaging portion of the support hooks which coating entirely covers the hooks except for the small area of contact with the workpiece. Unless a very similar workpiece is to be run in a subsequent operation, whereby the workpiece would be in electrical contact with the hook at an identical part, there will not be good electrical contact between the support hook and the workpiece. Thus, where a different workpiece is to be transported in a subsequent run it is necessary to provide a clean support hook to assure the requisite good electrical contact between the workpiece and the support hook. Accordingly, it is desirable that the support hooks be detachably engaged to the main frame of the rack so that the hooks can be periodically removed and replaced with new or cleaned hooks. Simple and rapid interchangeability of the support hooks is also desirable so that different sizes and shapes of support hooks can be interchanged as desired to allow for customization of the support rack to suit the requirements of a wide variety of runs. It is desirable to provide this interchangeability while still maintaining good electrical contact between each support hook and its respective support rack.

One workpiece support rack which is shown in the prior art is described in U.S. Pat. No. 4,217,853, and another is shown in German Pat. No. 1,079,916. A problem with the prior art racks is that they are either too expensive to manufacture or else do not provide the desired rearrangeability. It is desirable to provide a support rack which lends itself to simple and inexpensive manufacture while still providing for flexibility and also good electrical contact of the workpieces supported.

SUMMARY OF THE INVENTION

In accordance with the present invention there is provided an inexpensive support rack having removable support hooks which lend themselves to easy manual attachment and detachment while also maintaining good electrically conductive contact with the support frame.

One or more crossbars, which are hollow, flattened elongated members, are supported in a generally horizontal position and include hollow ends into which selective support hooks are engagingly received. The hollow crossbars include detents near the open ends thereof, which engage with a complementary crimp or bend in the support hooks upon insertion of the hooks into the open crossbar ends, to securely engage the support hook. Since the support hooks engage with the interior of the crossbars, the crossbars act as a shield to the particulate thereby maintaining good, clean electrically conductive contact of the support hooks with the interior of the crossbars. The support hooks are easily removable from the crossbars by exertion of manual force sufficient to overcome the detent engagement with the crossbars, with no tools required to customize a rack for a particular run. Accordingly, a wide variety of shapes and sizes of support hooks can be employed for supporting workpieces which are easily interchangeable while also providing good electrical contact with the support rack. Furthermore, the support rack of the present invention lends itself to simple and inexpensive manufacture as compared to prior support racks. Additional advantages will become apparent as the description proceeds and the features of novelty which characterize this invention will be pointed out with clarity.

BRIEF DESCRIPTION OF THE DRAWINGS

In the drawings, wherein like elements are referenced alike.

DETAILED DESCRIPTION OF THE PREFERRED EMBODIMENT

Figure 1:
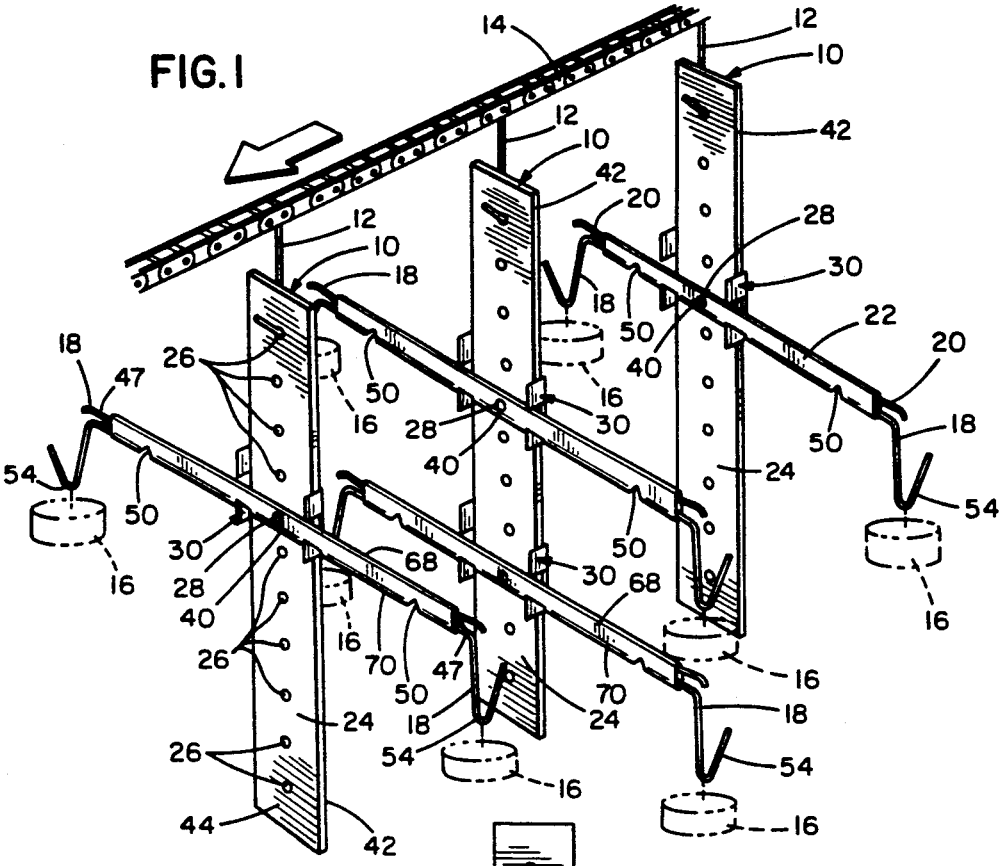
FIG. 1 is a perspective view of support racks embodying various features of the present invention being carried along by a conveyor.
Figure 2:
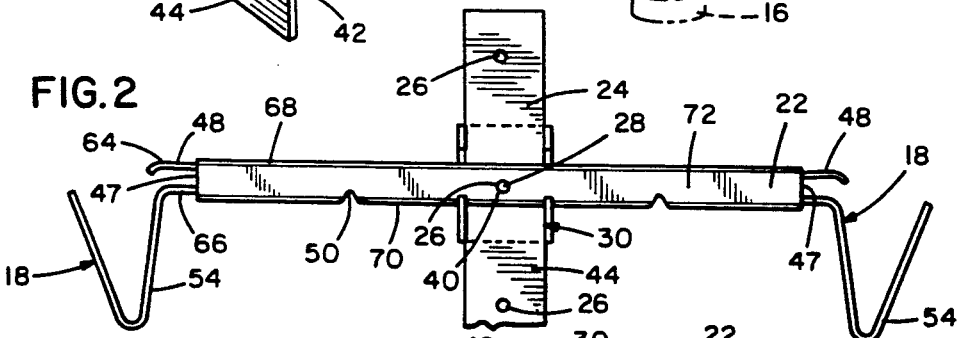
FIG. 2 is an enlarged front elevational view of one of the support racks illustrated in FIG. 1.
Figure 3:
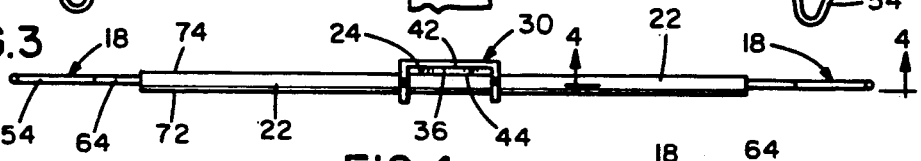
FIG. 3 is a top elevational view of the support rack of FIG. 2.

Support racks embodying various features of the present invention are illustrated in FIG. 1, and referred to generally at 10. The support racks 10 are shown depending from conveyor hooks 12 carried along by a chain conveyor drive 14 to transport the support racks 10, with their respective workpieces 16 supported thereon, through electrostatic coating operations and the like.

Workpieces 16 are hung from support hooks 18 which are detachably engaged within the open ends 20 of a crossbar or crossbeam portion 22 of the support rack 10. The detachable engagement of the support hooks 18 of the present invention allows for simple and rapid interchanging of a wide variety of support hooks 18. Accordingly, support hooks 18 can be removed and cleaned following passage through an electrostatic coating operation to remove accumulated paint therefrom, thereby assuring good electrical contact between the support hook 18 and workpieces 16 supported thereby upon subsequent employment of the support hook.

The support rack 10 includes a central strip 24 which depends vertically from the conveyor hooks 12. A plurality of apertures 26 are provided in the central strip 24, spaced along the length thereof, for securing crossbars or crossbeams 22 at desired vertical positions on the central strip 24. The crossbars 22 are provided with a crossbar aperture 28 at the center thereof which is aligned with one of the central strip apertures 26 to accommodate passage of a connecting member through the aligned apertures to effect securing of the crossbars 22 to the central strips 24. Since the central strip 24 includes a plurality of vertically extending apertures 26 and crossbars 22 are securable at any one of the apertures 26, one or more crossbars 22 are securable at selective vertical positions on the central strips 24.

Figure 5:
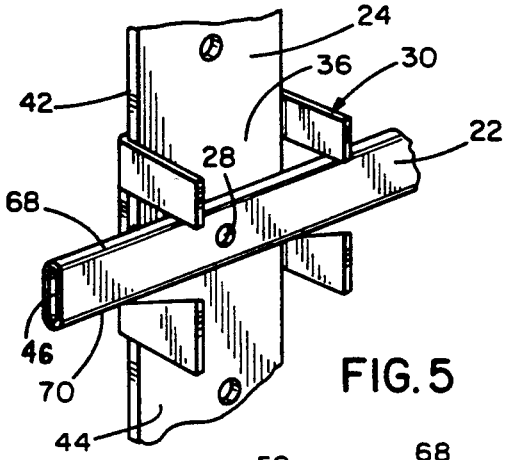
FIG. 5 is an enlarged, fragmentary perspective view of the crossbar engaging portion of the support rack of FIG. 1.
Figure 6:
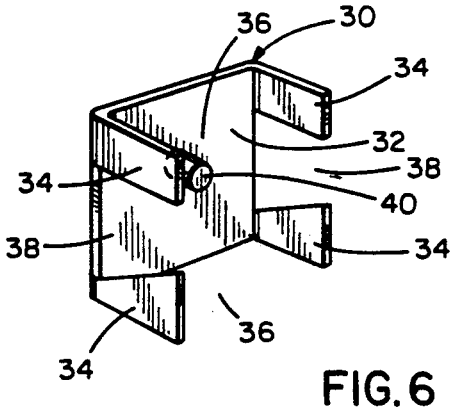
FIG. 6 is an enlarged perspective view of the bracket portion of the support rack of FIG. 1.

A bracket 30 is provided which engages with both the central strip 24 and the crossbar 22 to secure the crossbar 22 to the central strip 24 and to maintain the crossbar 22 in a generally horizontal position. With reference to FIGS. 5 and 6, the bracket 30 includes a base portion 32 with four tabs 34 integral therewith and extending generally perpendicularly therefrom. The tabs 34 define a vertical channel 36 for accommodation of the central strip 24, and a horizontal channel 38 for accommodation of the crossbar 22.

The bracket 30 further includes a connecting pin 40 integral therewith and extending generally perpendicularly from the center of the base portion 32 in the direction of the tabs 34. Thus, to assemble a support rack 10 for a run, the inner surface 41 of the base portion 32 of the bracket 30 is placed flush against the rear surface 42 of the central strip 24 with the central strip 24 accommodated within the vertical channel 36 and with the connecting pin 40 received in one of the apertures 26. A crossbar 22 is then placed flush against the front surface 44 of the central strip 24 and accommodated within the horizontal channel 38. The connecting pin 40 of the bracket 30 thus extends through both the central strip aperture 26 and the crossbar aperture 28. A quick release fastener (not shown) is then fastened to the portion of the connecting pin 40 extending through the crossbar aperture 28 to secure the crossbar 22 to the central strip 24. The tabs 34 of the bracket 34 prevent the crossbar 22 from rotating relative to the central strip 24, thereby maintaining the crossbar 22 in the desired horizontal position during transport.

Figure 11:
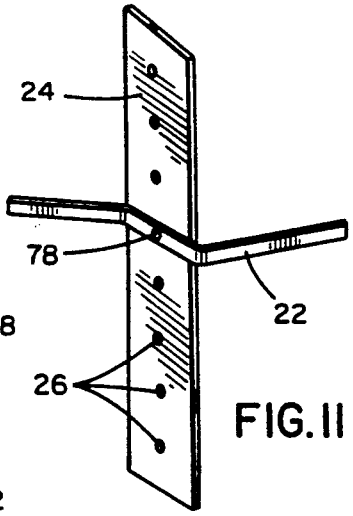
FIG. 11 is a perspective view of an alternative embodiment of a crossbar suitable for carrying out the present invention.
Figure 12:
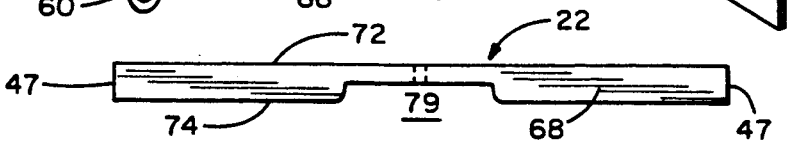
FIG. 12 is a plan view of an alternate crossbar embodiment suitable for attachment with a single screw.

While employment of a bracket 30 is desirable in many application to assure that the crossbar 22 is securely maintained in a horizontal position, it may be desirable in certain applications to secure the crossbar 22 to the central strip 24 by a single screw 78, as shown in FIG. 11. In the single screw embodiment of FIG. 11, the crossbar (shown in FIG. 12) includes an indentation 79 approximately midway between the opposite free ends 47 proportioned to accommodate the vertical strip 24. The indentation 79 provides resistance to rotation of the support bar 22 with respect to the vertical strip 24 and the screw 78 maintains the vertical strip 24 within the indentation 79. The single screw 78 allows for more rapid assembly and disassembly of the support rack 10 in comparison to the bracket 30. Also, employment of the single screw 78 embodiment minimizes the components which must be cleaned between successive runs of differing coating materials as compared to the bracket embodiment.

Accordingly, support racks 10 of the present invention lend themselves to rapid assembly and disassembly, thereby allowing for customization of the support racks 10 as desired to suit the particular needs of each run. That is, one or more crossbars 22 can be secured at any of one or more central strip apertures 26. For instance, in FIG. 1 the center support rack 10 is shown with two crossbars 22 secured thereto, while the support racks 10 one either side thereof are shown with only one crossbar 22. Also, a given support rack 10 may include crossbars 22 having different lengths to accommodate certain shapes of workpieces 16.

The crossbars 22 are hollow, flattened members and define narrow openings 46 at the opposite free ends 47 thereof into which the crossbar engaging portion 48 of the support hooks 18 are received. While the crossbars 22 can be manufactured in a flattened state originally, to minimize manufacturing costs, the crossbars are preferably simply tubular metal members which are later flattened into the desired shape.

The crossbars 22 further include indentations or detents 50 near the open ends 47 which extend inward on the crossbar 22 interior forming a discontinuity on the crossbar interior surface. The indentations 50 are provided for engaging the support hooks 18 within the open ends 47 of the crossbar 22 by engagement of the indentation 50 with a complementary bend or curve 52 in the support hook 18, as explained further below.

The indentations 50 are preferably formed by crimping or crushing the exterior of the crossbar 22 to plastically deform the crossbar inwardly. The crossbar 22 can be crimped inward at the lower end 70 in the direction of the upper end 68, or, alternatively, crimped or pinched at the lower end bringing together the opposing front side 72 and rear side 74 of the crossbar at that point. Other means for providing a detent or indentation 50 in the crossbar interior are equally well suited, and the invention is not limited to any particular manner of forming the indentation 50 nor is it limited to any particular shape of indentation.

Figure 7:
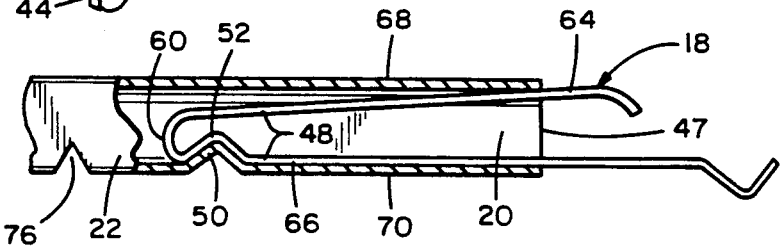
FIG. 7 is an enlarged, fragmentary cross-sectional view of an alternative embodiment of support hook engaged with the support rack of FIG. 1.
Figure 8:
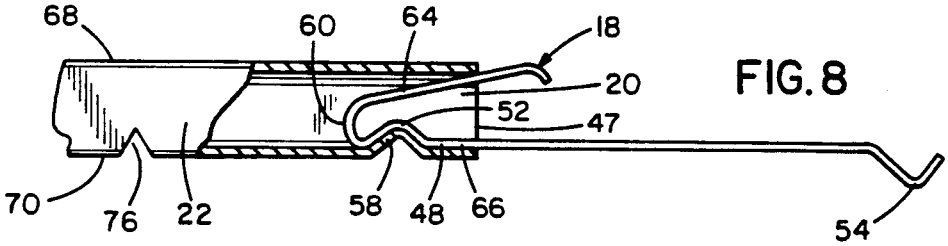
FIG. 8 is a cross-sectional view of the support hook and support rack engagement of FIG. 7 with an alternative embodiment of the crossbar with the detent positioned near the open end.

The crossbar 22 may also include a notch or drainhole 76 therein which is formed by removing a small portion of the bottom end 70 of the crossbar 22 (see the embodiment of FIGS. 7 and 8). The drainhole 76 provides a drainage passageway through which water can drain from the interior of the crossbar 22. That is, as stated above, workpieces 16 are often transported through a washing station prior to transport through a painting station. Water may enter the crossbar 22 curing the washing process. Since water is detrimental to electrostatic coating operations, the drainhole 76 is provided in the bottom end 70 of the crossbar 22 to allow water to drain from the crossbar under the influence of gravity prior to entering a painting station.

While the preferred embodiment includes crossbars 22 having two opposing open ends 47 spaced generally equidistant from a centrally located support to provide balancing of the crossbars 22, it may be desirable in certain situations to provide a crossbar 22 having only one open end 47 into which support hooks 18 are engagingly received. Furthermore, in addition to the preferred planar crossbar 22 configuration illustrated in FIGS. 1 through 8, crossbars having non-planar configurations, such as that illustrated in FIG. 11, may be desirable for certain applications.

Figure 4:
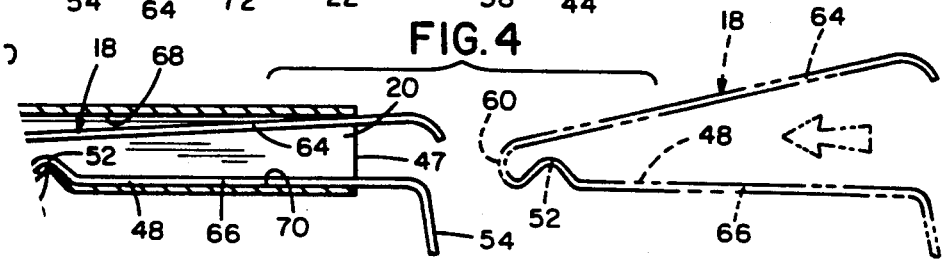
FIG. 4 is an enlarged fragmentary cross-sectional view of a preferred support hook taken in line 4—4 in FIG. 3 and showing in dashed lines the support hook in its disassembled position.

The support hooks 18, upon which workpieces 16 to be coated are hung, include a crossbar engaging portion 48 and a workpiece engaging portion 54. In the preferred embodiment, the crossbar engaging portion 48 is resilient and is doubled-over or bent over itself as best seen in FIGS. 4 and 7 to define an upper crossbar engaging portion 64 and a lower crossbar engaging portion 66. With particular reference to FIG. 4, it is seen that the doubled-over crossbar engaging portion 48 is wider in its natural state (see phantom lines) than the open end 20 of the crossbar 22.

The leading end 60 of the support hook 18, at which the crossbar engaging portion 48 of the support hook 18 is bent over, is narrower than the openings 20 in the crossbar ends allowing for slidable manual insertion of the support hook 18 into the open end 20. Upon insertion of the leading end 60 of the crossbar engaging portion 48 of the support hook 18 into an open end 20 of the crossbar 22, the doubled-over resilient crossbar engaging portion 48 is deflected inward, with the doubled-over sections 64 and 66 of the support hook deflected toward one another by camming action of the support hook 18 against the crossbar 22 so that the support hook 18 can slide relatively easily into the open end 20 of the crossbar 22. The doubled-over, crossbar engaging portion 48 of the support hook 18 is shown in its natural, undeflected position by the phantom lines to the right in FIG. 4. This same support hook 18 is shown in a deflected position within a crossbar 22 by the solid lines to the left in FIG. 4.

Thus, after insertion, the doubled-over upper crossbar engaging portion 64 and the lower crossbar engaging portions 66 of the support hook 18 are deflected inward toward one another, assuming the position shown to the left in FIG. 4. The doubled-over crossbar engaging portion 48, being resilient, tends toward resuming its natural expanded position, thereby biasing the upper crossbar engaging portion 64 and the lower crossbar engaging portion 66 of the support hook 18 respectively against the opposing upper end 68 and lower end 70 of the crossbar 22.

The biasing of the workpiece engaging portion 48 of the support hook 18 against the interior surface of the crossbar 22 assures good electrical contact between the crossbar 22 and the support hook 18, which is an essential requirement in electrostatic coating support racks 10. The sliding engagement of the crossbar engaging portion 64 of the support hook 18 against the interior of the crossbar 22 tends to provide self cleaning thereat, helping to maintain good low resistance contact. Furthermore, since the contact is made within the interior of the crossbar 22, the crossbar acts as a shield to prevent the coating particulate from accumulating on the portions of the support hook 18 situated within the crossbar 22. Therefore, only those portions of a fully inserted support hook 18 which extend outside of the crossbar 22 will be exposed to the particulate.

The accumulation of particulate on the exterior of the crossbar 22 will not affect the conductivity between the crossbar 22 and the support hook 18. However, accumulation of particulate on the workpiece engaging portion 54 of the support hooks 18 does present potential conductivity problems. That is, during transport through an electrostatic coating operation, the entire surface of the exposed workpiece engaging portion 54 of the support hook 18 will accumulate particulate thereon except in the areas at which workpieces 16 are hung. The workpieces 16 may be hung directly from the support hooks 18 or hung on wires or hooks from the support hooks 18. The support hook 18 is shielded by the workpiece, or its supporting wires if employed, at the point of connection of the workpiece 16 thereby preventing particulate from accumulating at the point of connection. Thus, good electrically conductive contact is maintained between the support hook 18 and the workpiece 16 supported thereby throughout transport despite the accumulation of particulate on the support hook everywhere except the point of connection of the workpiece 16 to the support hook 18. However, when a different workpiece 16 is run which contacts the workpiece engaging portion 54 of the support hook 18 at a different location than the previously run workpiece, the point of contact between the workpiece and the support hook may not include the previously shielded, and thus uncoated, portion of the support hook. Thus, unless the support hook is cleaned to remove the coated particulate therefrom, there will not be good electrical contact between the workpiece and the support hook.

The support hooks 18 of the present invention are easily attachable and detachable from the support racks 10 to allow for removal of coated support hooks and insertion of clean support hooks following a coating run. Thus, by maintaining a supply of extra support hooks 18, clean support hooks can be employed at all times, while coated support hooks are being cleaned for later use. Continual employment of clean support hooks 18 assures good electrical contact between the support hooks 18 and their associated workpieces 16 depending therefrom. The construction of the support rack 10 of the present invention, with the crossbar 22 shielding a significant portion of the support hook 18 to prevent particulate from accumulating over the shielded area, lends itself well to the repetitive cleaning requirements of the support hooks by minimizing the amount of particulate which needs to be cleaned from the support hooks.

The biasing force of the support hook 18 against the interior of the crossbar 22 may be insufficient to satisfactorily secure the support hook 18 within the crossbar 22. The aforementioned detent or indentation 50 in the crossbar 22 is provided to matingly engage with the complementary bend or curve 52 in the support hook 18 to provide additional securing of the support hook 18 within the crossbar 22. That is, the lower crossbar engaging portion 66 of the support hook 18 is provided with a small bend 52 therein adjacent the leading end 60 which bend 52 extends toward the upper workpiece engaging portion 64. The bend 52 is proportioned in relation to the indentation 50 so that there is mating engagement therebetween upon manual insertion of the support hook 18 into an open end 20 of the crossbar 22. The indentation 52 in the crossbar 22 should be sufficiently spaced from the open end 20 of the crossbar so that there is a sufficient amount of the support hook 18 extending within the crossbar 22 to provide the requisite cantilever support for the support hook 18.

Thus, to attach a selective support hook 18 to the support rack 10, the leading end 60 of the workpiece engaging portion 48 of the support hook 18 is inserted into an open end 20 of the crossbar 22 with sufficient force so that the resilient leading end 60 of the support hook 18 is temporarily deflected upward by camming action against the indentation 50 to clear the indentation 50. Following the leading end 60 of the support hook clearing or passing the indentation 50, the indentation 50 is then engagingly received within the bend 52 of the support hook 18 which is adjacent to the leading end 60. The snapping or clicking of the leading end 60 of the support hook 18 over the indentation 50 in the crossbar 22 securely engages the support hook 18 within the crossbar 22. The support hook 18 is thereby securely engaged within the open end 20 of the crossbar 22 and is thereafter normally only removed by an operator intentionally pulling outward on the support hook 18. Removal of the support hooks is discussed further, below.

Figure 9:
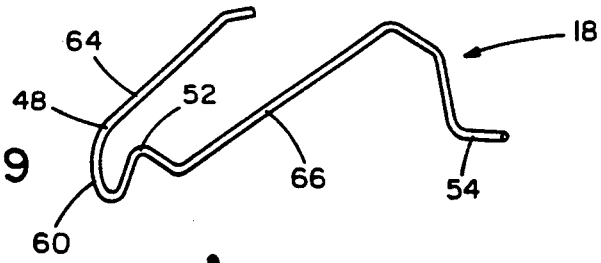
FIG. 9 is a perspective view of a second alternative embodiment of a support hook embodying various features of the present invention.
Figure 10:
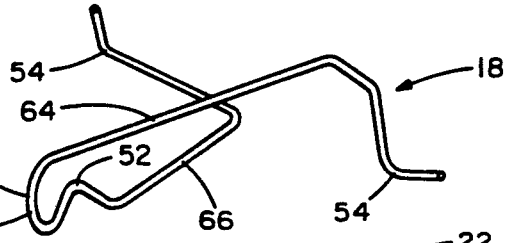
FIG. 10 is a perspective view of a third alternative embodiment of a support hook suitable for carrying out the present invention.

The engagement of the complementary indentation 50 and bend 52 also acts as a detent stop, whereby during insertion of a support hook 18 within the crossbar open end 20, an operator will feel the engagement or hear the click sound indicating engagement and know that the support hook has been fully inserted, and that no further insertion is desirable. This provides for precise positioning of the support hooks 18 within the crossbars, and eliminates operator error attributable to over-insertion or under-insertion of the support hooks 18. Other support hook arrangements are also suitable for carrying out the present invention. The construction of the support rack 10 of the present invention allows for great variation in the size and shape of support hooks. In addition to the preferred planar support hook configuration illustrated in FIGS. 1–8, examples of additional non-planar designs, in which the workpiece engaging portion 54 is at an angle with respect to the crossbar engaging portion 48, are illustrated in FIGS. 9 and 10. The support hook 18 illustrated in FIG. 10 is illustrative of the wide variety of potential support hook configurations employable. The support hook illustrated therein includes two workpiece engaging portions 54 integral with the crossbar engaging portion 48 which allows two separate workpieces to be supported from a common support hook. While this is not the preferred support hook configuration, this configuration may be well suited for transporting small, lightweight workpieces.

The support hooks 18 are manually removable from the crossbar 22 by squeezing together the upper crossbar engaging portion 64 and the lower crossbar engaging portion 66 and then pulling outward, generally in the direction of the axis of the crossbar 22, to overcome the detent engagement. Specifically, downward movement of the upper crossbar engaging portion 64 effects slight upward movement of the leading end 60 of the support hook 18, which allows for overcoming of the detent engagement with less pulling force that otherwise required.

It should now be appreciated that an infinite variety of configurations of the workpiece engaging portion 54 of the support hooks 18 are employable with the support rack 10 of the present invention so long as the crossbar engaging portion 48 of the support hooks 18 includes a resilient bent over portion with a bend 52 therein. It should now also be appreciated that the support rack 10 of the present invention lends itself to simple and inexpensive manufacture, and therefore lends itself to production at low cost.

In summary, the support rack 10 of the present invention readily lends itself to customization to suit the requirements of a particular coating operation. One or more crossbeams 22 are easily attachable and detachable at any of the apertures 26 in the vertical strip 24 allowing for vertical height adjustment of the crossbars 22, and the support hooks 18 on which the workpieces 16 are supported are easily attachable and detachable from the crossbar open ends 20 allowing for employment of a virtually infinite number of differing sizes and shapes of support hooks 18. Thus, the support rack 10 of the present invention can be customized to suit a very wide variety of coating operations. Yet despite the simple and inexpensive design and simple customization aspects of the support rack 10, good electrical conductivity is maintained between the support racks 10 and the workpieces 16.

While the invention has been described with reference to a preferred embodiment and several alternative embodiments, it will be understood to those skilled in the art that various changes may be made and equivalents may be substituted for elements thereof without departing from the scope of the invention. In addition, many additional modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

I claim:

1. A support rack for supporting workpieces during transport through a finishing station, comprising:

a support frame including a crossbar having an elongated, substantially enclosed hollow interior with a pair of ends, one of which is a hollow open end and a detent extending into said hollow interior spaced inwardly from said hollow open end; and a support hook having a workpiece engaging portion and a resiliently deformed crossbar engaging portion which releasably engages with the crossbar and the detent upon insertion of the support hook into said open end of the crossbar.

2. A support rack in accordance with claim 1 wherein said crossbar includes a support frame engagement means and includes two opposite, open ends equidistant from said support frame engagement means.

3. A support rack in accordance with claim 1 wherein said support frame includes a plurality of crossbars and a plurality vertically spaced crossbar engaging means for simultaneously supporting said plurality of crossbars.

4. A support rack in accordance with claim 1 wherein said support frame includes a vertically extending member a securing bracket engaging both said vertical member and said crossbar to maintain said crossbar in a horizontal position.

5. A support rack for supporting workpieces during transport through a finishing station, comprising;

a support frame including a crossbar having a pair of hollow open ends and a detent in proximity with said hollow open end; and a support hook having a workpiece engaging portion and a resiliently deformed crossbar engaging portion which releasably engages with the crossbar and the detent upon insertion of the hook into said open end of the crossbar;

said crossbar being flattened adjacent said hollow open ends to provide narrow vertically extending openings at the ends to prevent rotation of the support hooks within the ends.

6. A support rack in accordance with claim 1 wherein said detent includes an inwardly extending discontinuity in the crossbar interior.

7. A support rack for supporting workpieces during transport through a finishing station, comprising;

a support frame including a crossbar having a pair of ends one of which is a hollow open end and a detent in proximity with said hollow open end; and a support hook having a workpiece engaging portion and a resiliently deformed crossbar and the detent upon insertion of the hook into said open end of the crossbar;

said crossbar engaging portion of the support hook including a folded-over portion which extends into engagement against the interior of the crossbar, exerting oppositely directed biasing forces against opposing sides of the crossbar for releasably retaining said support hook in said crossbar in electrically conductive contact with said crossbar.

8. A support rack in accordance with claim 7 wherein the leading end of the folded-over crossbar engaging portion of the support hook includes a bend which engages said detent upon insertion of said hook into said open end of said crossbar for releasably retaining said support hook with respect to said crossbar.

9. A support rack in accordance with claim 7 wherein the folded-over crossbar engaging portion of the support hook includes a bend in proximity with the leading end thereof extending away from the crossbar detent.

10. A support rack in accordance with claim 1 wherein the crossbar engaging portion of the support hook defines a plane and at least a portion of the workpiece engaging portion of the support hooks extends at an angle with respect to the plane defined by the crossbar engaging portion.

11. A support rack for supporting workpieces during transport by a conveyor through an electrostatic coating operation, comprising:

a conveyor engaging member for connecting said support rack with the conveyor, the conveyor engaging member defining a plurality of vertically spaced apertures therein;

a hollow crossbar having opposite open ends and an indentation in proximity with each of the ends, the crossbar defining at least one engagement aperture near its center for engagement with the conveyor engagement member;

a securing bracket engageable with both the conveyor engaging member and the crossbar to maintain the crossbar in a generally horizontal position during transport, the bracket including an engaging pin receivable in the conveyor engagement member aperture and the crossbar engagement aperture to maintain secure engagement of the crossbar with the conveyor engaging member; and a support hook having a workpiece engaging portion and a resiliently deformable crossbar engaging portion which releasably engages with the crossbar and the indentation upon insertion of the crossbar engaging portion into an open end of the crossbar.

12. A support hook for supporting a workpiece in removable engagement with a support rack having hollow, opposing open ends with a detent in proximity with the ends and defining an internal passageway having opposite sidewalls and the support hook comprising:

a workpiece engaging portion for supporting engagement with a workpiece; and a resiliently deformed support rack engaging portion which releasably engages with the support rack and the detent thereof upon insertion of the hook into an open end of the support rack.

13. A support hook in accordance with claim 12 wherein said crossbar engaging portion of the support hook includes a bend therein complementary to said detent, for engagement of said bend with the detent upon insertion of the hook into a support rack opening.

14. A support hook in accordance with claim 12 wherein said crossbar engaging portion includes a resiliently deformed folded-over portion which is biased to an unfolded position to exert oppositely directed biasing forces against the opposite sidewalls of the support rack upon engagement within said support rack for releasably retaining said support hook in said support rack in electrically conductive contact with said support rack.

15. A method of supporting workpieces during transport through electrostatic spray operations, comprising:

providing a support rack having open, opposing ends with elongated recesses extending inwardly from said open ends;

forming inwardly extending indentations in said elongated recesses in proximity with the open ends thereof;

deforming a resilient rod to form a support rack engaging portion having a bend therein for engagement with the indentation and a workpiece engaging portion upon which workpieces are supportable;

inserting said support rack engaging portion of the rod into an open end of the support rack to releasably engage said rod and said support rack.

16. A method in accordance with claim 15 wherein said rod deformation includes doubling over of the support rack engaging portion so that it is then resiliently biased to an unfolded position exerting oppositely directed biasing forces against opposing sides of said recesses upon engagement within said support rack open ends for releasably retaining said support hook in said support rack in electrically conductive contact with said support rack.

17. A method in accordance with claim 16 in which said doubled-over portion of the rod defines a leading end for insertion into the support rack openings and said bend is adjacent said leading end.

* * * * *